US008002569B2

(12) United States Patent
Ikeda et al.

(10) Patent No.: US 8,002,569 B2
(45) Date of Patent: Aug. 23, 2011

(54) ELECTRIC CONNECTION BOX

(75) Inventors: Tomohiro Ikeda, Shizuoka (JP); Kazuyuki Kawashita, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/458,801

(22) Filed: Jul. 23, 2009

(65) Prior Publication Data

US 2010/0055962 A1 Mar. 4, 2010

(30) Foreign Application Priority Data

Aug. 29, 2008 (JP) ..... 2008-220909

(51) Int. Cl.
*H01R 13/64* (2006.01)

(52) U.S. Cl. ..... 439/374

(58) Field of Classification Search ..... 439/330, 439/357–358, 374, 345
See application file for complete search history.

(56) References Cited

U.S. PATENT DOCUMENTS 6,435,882 B1 * 8/2002 Pitou ..... 439/70
6,443,779 B2 * 9/2002 Suzuki ..... 439/701
2007/0010123 A1 1/2007 Ikeda

FOREIGN PATENT DOCUMENTS

JP 2007-020357 1/2007

* cited by examiner

*Primary Examiner* — Renee S Luebke
*Assistant Examiner* — Larisa Z Tsukerman
(74) *Attorney, Agent, or Firm* — Edwards Angell Palmer & Dodge LLP

(57) ABSTRACT

An electric connection box which can easily attach electric components to an attachment portion of box body. The electric connection box includes a box body having the attachment portion attaching the relay on an upper surface of the box body, and a relay fixed on the box body. The attachment portion includes a tube, a plurality of openings and a plurality of holding portions arranged in the opening. The tube inserts the relay into an inside thereof, and stands from the upper surface. The opening passes through the tube 5, and is arranged with a space along a circumferential direction of the tube. The holding portion presses the relay toward the inside of the tube, and holds the relay to the tube. The holding portion includes an arm and a protrusion projecting toward the inside of the tube.

4 Claims, 4 Drawing Sheets

ELECTRIC CONNECTION BOX

The priority application Japan Patent Application No. 2008-220909 upon which this patent application is based is hereby incorporated by reference.

BACKGROUND OF THE INVENTION

1. Field of the Invention

The present invention relates to an electric connection box mounted in a vehicle such as a motor vehicle.

2. Description of the Related Art

In a vehicle such as a motor vehicle, generally, various electronic devices are mounted. For example, lights such as headlights and a rear light, and motors such as a starter motor and a motor for air-conditioning are mounted in a vehicle.

A junction block is arranged on the vehicle so as to provide the above mentioned electronic devices with electrical power. The junction block is formed by putting together various electric circuit units of multiple fuses and relays.

Also, a junction block has fuses, relays and bus bars. For this reason, the junction block is called a fuse box, a relay box or an electric connection box (for example, see the patent document 1). In the present specification, the above mentioned fuse box, the relay box and the junction block are referred to as an electric connection box.

An electric connection box described in the patent document 1 includes a box body, a cover and so on. The box body forms outline, and the cover is installed in the box body. The box body is made of insulation synthetic resin, and formed into a box shape. In a surface of the box body, an attachment portion in which electric components such as a relay and a fuse are attached is included.

The attachment portion includes a through hole, a plurality of guide walls, and a locking portion. The through hole passes through the box body, and inserts a terminal of the electric component. The guide walls stand from the surface of the box body, and are arranged at intervals. Also, the guide walls are disposed around the through hole. The locking portion stands from the surface of the box body. Furthermore, the locking portion locks in locking protrusions of the electric component arranged between the plurality of the guide walls. In the plurality of the guide walls, a plurality of protrusions which project toward the insides of the guide walls is arranged on a tip away from the surface of the box body respectively.

In the above structured electric connection box, by inserting the electric component into an inside of the guide wall of the attachment portion, protrusion of the guide wall presses the electric component into the inside of the guide wall. Furthermore, the locking portion is fitted in the locking protrusion. Thereby, the electric component is fixed in the attachment portion.

Patent Document 1

Japan published patent application 2007-20357

SUMMARY OF THE INVENTION

The present invention provides an electric connection box, which can easily attach an electric component to an attachment portion of a box body.

According to a first aspect of the present invention, an electric connection box includes a box body, and an attachment portion attaching an electric component on a surface of the box body. The attachment portion includes a tube standing from the surface and inserting the electric component into the inside thereof, a plurality of openings passing through the tube and arranged with a space along a circumferential direction of the tube, and a plurality of holding portions provided in the opening and holding the electric component to the tube by pressing the electric component into the inside of the tube. Each of the holding portions includes an arm and a protrusion projecting toward the inside of the tube from another end of the arm, one end of the arm continues to an inner edge of the tube away from the surface of the box body, and the other end thereof is formed with a free end.

According to a second aspect of the present invention, at least the two protrusions opposed to each other respectively lock with locking protrusions of the electric component when the electric component is received in the tube.

According to a third aspect of the present invention, the protrusion includes a slope narrowing toward a top of the protrusion at the other end side whereas one end side of the protrusion faces the surface of the box body.

Effect of the Invention

According to the invention, when the electric component is inserted into the tube of the attachment portion, each the arm of the holding portion is elastic deformed. Furthermore, each the protrusion of the holding portion is pushed to the outside of the tube by the electric component. Thereby, insertion force so as to insert the electric component into the tube of the attachment portion can be reduced. Consequently, the electric component can be easily attached to the attachment portion in the box body.

According to the invention, holding and fixing the electric component to the tube can be performed together simply by inserting the electric component into the tube of the attachment portion. Thereby, it is possible to reduce the number of parts and working process for attaching the electric component to the attachment portion of the box body.

According to the invention, when the protrusion is pushed to the outside of the tube by the electric component which is inserted to the tube of the attachment portion, friction between the electric component and the protrusion can be reduced. Therefore, insertion force so as to insert the electric component into the tube of the attachment portion can be reduced. Additionally, the electric component can be smoothly inserted into the tube of the attachment portion. Also, damage of the electric component and the protrusion can decrease, and the electric component can be steadily fixed to the attachment portion of the box body.

The above and other objects and features of this invention will become more apparent from the following description taken in conjunction with the accompanying drawings.

DESCRIPTION OF AN EXEMPLARY EMBODIMENT

Figure 1:
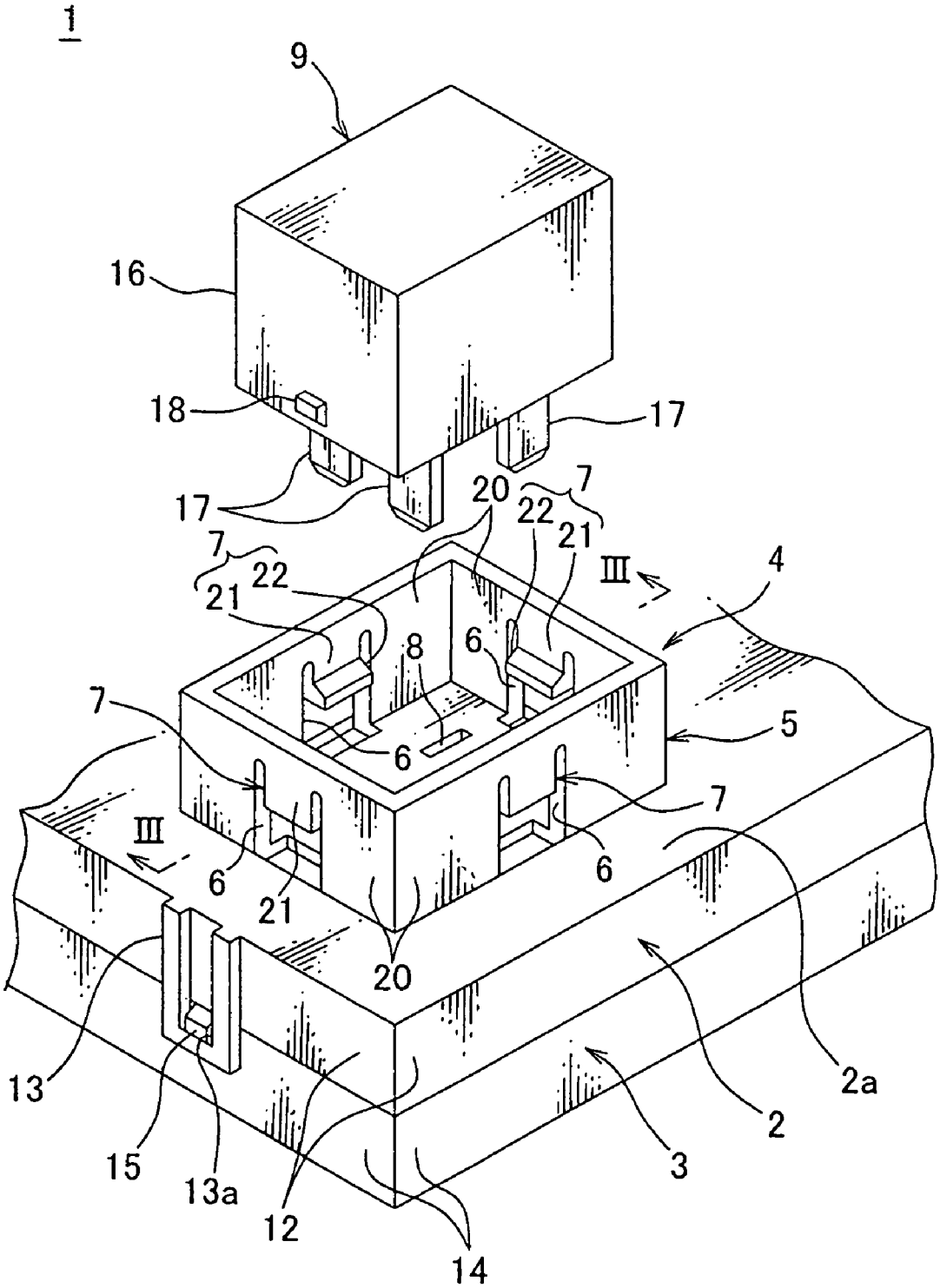
FIG. 1 is a perspective view showing an electric connection box of an embodiment of the present invention.

An electric connection box according to one embodiment of the present invention is explained by referring to FIGS. 1-6. An electric connection box 1 shown in FIG. 1 is mounted on a vehicle such as a motor vehicle.

As shown in FIG. 1, the electric connection box 1 includes a box body 2, a lower cover 3, a relay 9 as an electric component and a wiring board not shown. The box body 2 is made of insulation synthetic resin, and is formed by known injection molding. The box body 2 has a ceiling wall 11 and a plurality of outer walls 12. The box body 2 is formed into a box shape. The outer walls 12 extend from an outer edge of the ceiling wall 11 and continue to each other. In the inside of the box body 12, a space for receiving the wiring board is formed.

In an upper surface 2*a* (correspond to a surface) of the box body 2, a plurality of attachment portions 4 is provided. The relay 9 is attached to the attachment portion 4. Explanation of the attachment portion 4 will hereinafter be described in detail.

The outer wall 12 of the box body 2 includes a plurality of locking portions 13 for fixing the box body 2 and the lower cover 3. The locking position 13 projects from the outer wall 12, and is formed in a U-shape. The locking portion 13 includes an engaging hole 13*a*. The engaging hole 13*a* engages with a locking protrusion 15 of the lower cover 3.

The locking protrusion 15 of the lower cover 3 is engaged in the engaging hole 13*a* of the locking portion 13. As a result, the locking protrusion 15 is engaged in the locking portion 13. Thereby, the lower cover 3 is fixed in a lower surface of the box body 2.

The lower cover 3 is made of insulation synthetic resin, and is formed by known injection molding. The lower cover 3 includes a bottom wall not shown and a plurality of outer walls 14 extending from an outer edge of the bottom wall. The lower cover 3 is formed into a bottomed cylinder shape. In the outer wall 14 of the lower cover 3, a plurality of the locking protrusions 15 is provided. The locking protrusion 15 engages with the above locking portion 13. A connector provided on a terminal of wiring harness, which connects with various electric devices mounted on a vehicle, is fitted to a bottom wall (not shown) of the cover 3.

The locking protrusion 15 engages with the locking portion 13 of the box body 2. The lower surface of the box body 2 is covered with the lower cover 3, and the lower cover 3 is fixed in the box body 2. When the box body 2 and the lower cover 3 are assembled each other, the box body 2 and the lower cover 3 are approached each other along a direction perpendicular to the ceiling wall 11 and the bottom wall.

The relay 9 includes a block-shaped main body 16, a plurality of terminals 17 formed into a plate shape, and a pair of locking protrusions 18. The main body 16 receives an internal coil in the inside thereof. The terminal 17 projects from a bottom surface not shown, and has conducting properties. The locking protrusions 18 protrude on a side surface, and opposed to each other.

When the relay 9 is attached to the attachment portion 4, the plurality of the terminals 17 pass through the through holes 8 of the attachment portion 4 and are connected with a bus bar respectively. The pair of the locking protrusions 18 are arranged opposed to each other along a radial direction of the main body 16. When the relay 9 is installed in the attachment portion 4, the pair of locking protrusions 18 are locked in a protrusion 22 of the holding portion 7 respectively. Thereby, the relay 9 is fixed to a tube 5 of the attachment portion 4.

The wiring board includes a conductive bus bar and an insulating plate and so on. The bus bar is formed by pressing and punching in a conductive plate. A plurality of the bus bars is provided, and overlaps each other. The insulating plate is arranged between the bus bars, and prevents short circuit. A position of the bus bar is determined by the insulating plate.

When the above mentioned wiring board is received in the box body 2, the bus bar electrically connects the connector of the wiring harness and the relay 9, which is attached to the attachment portion, each other according to a predetermined pattern.

Figure 2:
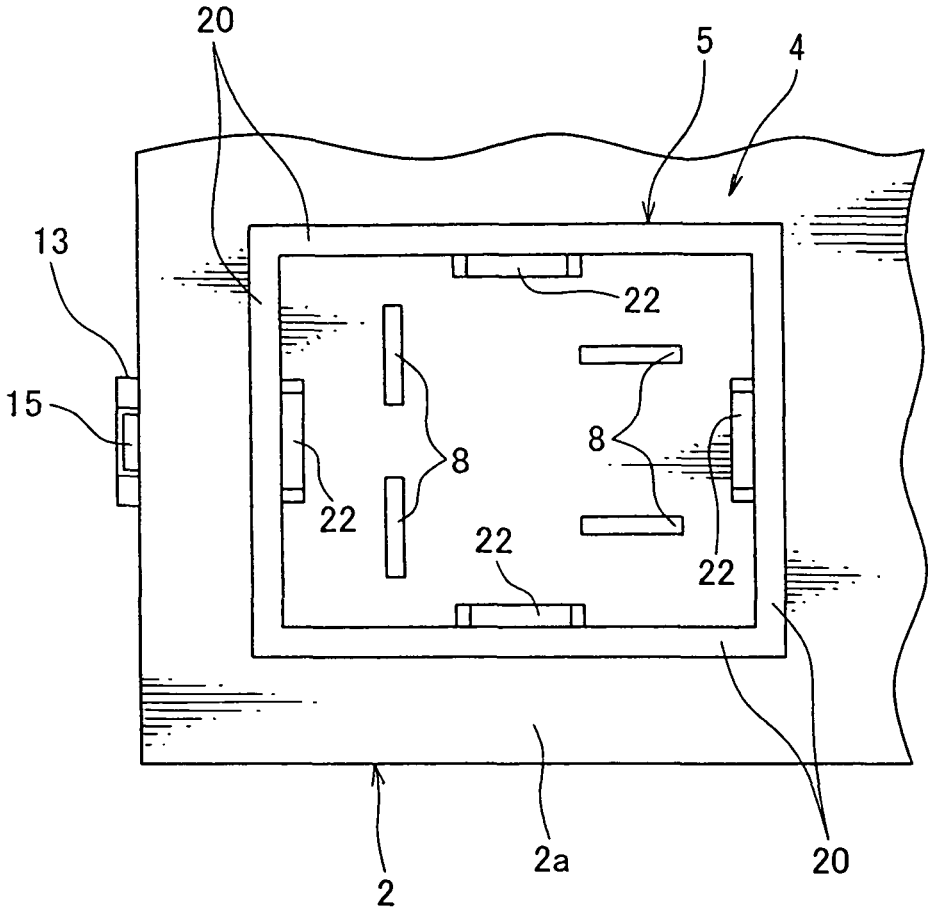
FIG. 2 is a plan view showing an attachment portion of the electric connection box in FIG. 1.

As shown in FIGS. 1 and 2, the attachment portion 4 includes the tube 5, a plurality of openings 6, a plurality of holding portions 7 and a plurality of through holes 8. The tube 5 inserts the relay 9 into the inside thereof. The holding portions 7 are held to the tube 5 by pressing the relay 9 toward the inside of the tube 5. The through holes 8 pass through each the terminal 17 of the relay 9. The tube 5 stands from the upper surface 2*a* of the box body 2, and includes a plurality of peripheral walls 20. The tube 5 is formed into a rectangular shape.

The plurality of openings 6 are arranged on the peripheral wall 20 of the tube 5 respectively. Furthermore, each of the opening 6 passes through the peripheral wall 20. A planer view of the opening 6 is formed into a rectangular shape. That is, the plurality of openings 6 are arranged with a space each other along a circumferential direction of the tube 5.

Figure 3:
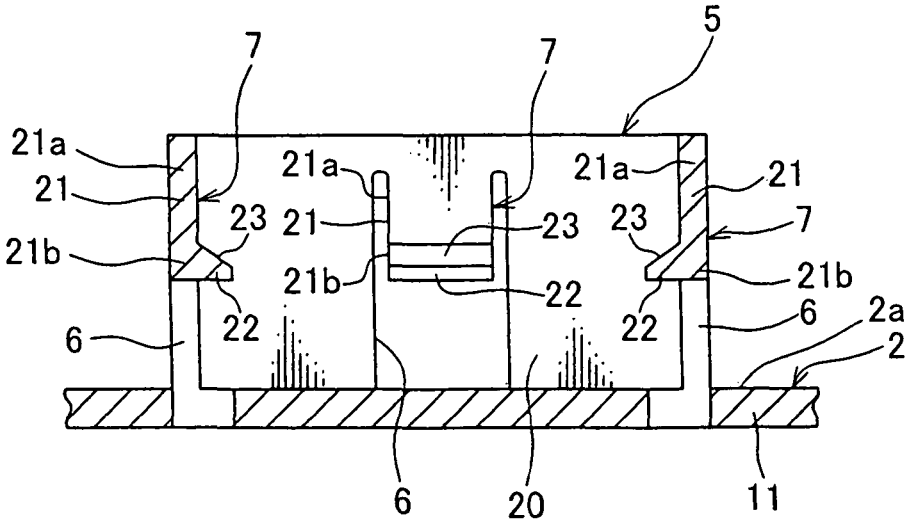
FIG. 3 is a sectional view taken along the line III-III of FIG. 1.

The holding portion 7 is arranged in the inside of opening 6 provided in the peripheral walls 20, and includes an arm 21 and a protrusion 22. As shown in FIGS. 1 and 3, the arm 21 is formed into a band plate shape. One end 21*a* of the arm 21 is connected to an inner edge side away from the upper surface 2*a* of the box body 2. Another end 21*b* thereof is a free end. Furthermore, the arm 21 is elastically deformable.

The protrusion 22 is arranged on the other end 21*b* of the arm 21, and projects from the other end 21*b* toward the inside of the tube 5. Furthermore, as shown in FIG. 3, the protrusion 22 includes a slope 23. The slope 23 slopes from a part of the arm 21 toward the upper surface 2*a* of the box body 2. That is, the slope 23 narrows toward a top of the protrusion 22 at the other end side.

As shown in FIG. 2, the plurality of through holes 8 pass through the ceiling wall 11 of the box body 2 respectively. A planar view of the through hole 8 is formed into a rectangular shape. The through hole 8 is arranged on an inside of the tube 5. When the relay 9 is attached to the attachment portion 4, the terminal 17 of the relay 9 is inserted into the through hole 8.

Figure 4:
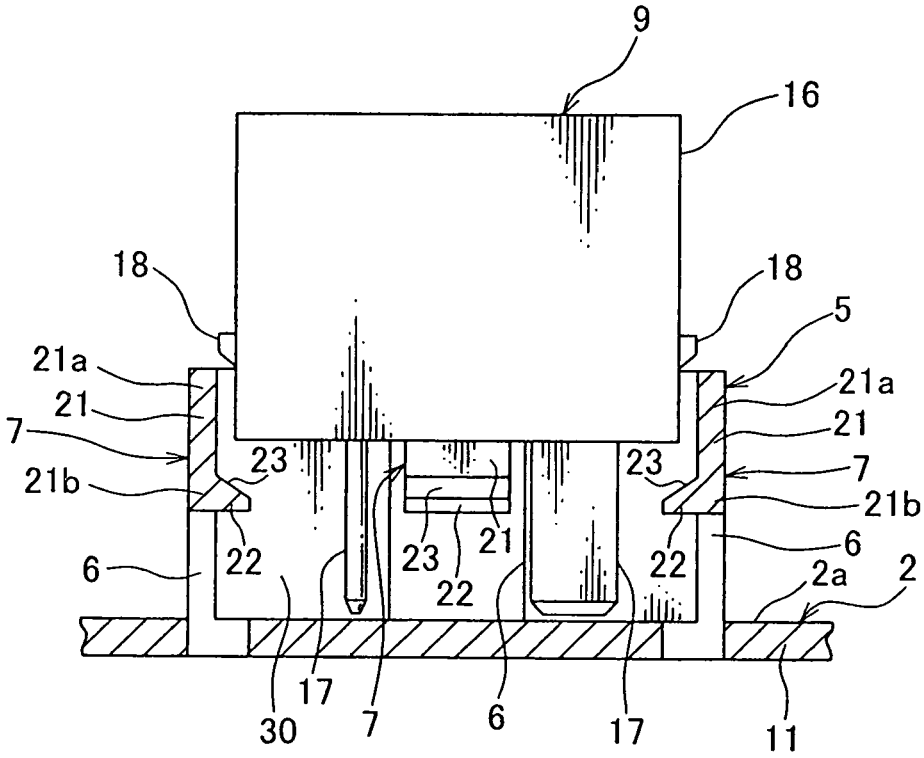
FIG. 4 is a cross-sectional view showing condition inserting an electric component into a tube of the attachment portion in FIG. 3.

As shown in FIG. 1, in the above electric connection box 1, the relay 9 is opposed to the attachment portion 4. Also, as shown in FIG. 4, the relay 9 is inserted into the tube 5 of the attachment portion 4 from the terminal 17 side of the relay 9.

Figure 5:
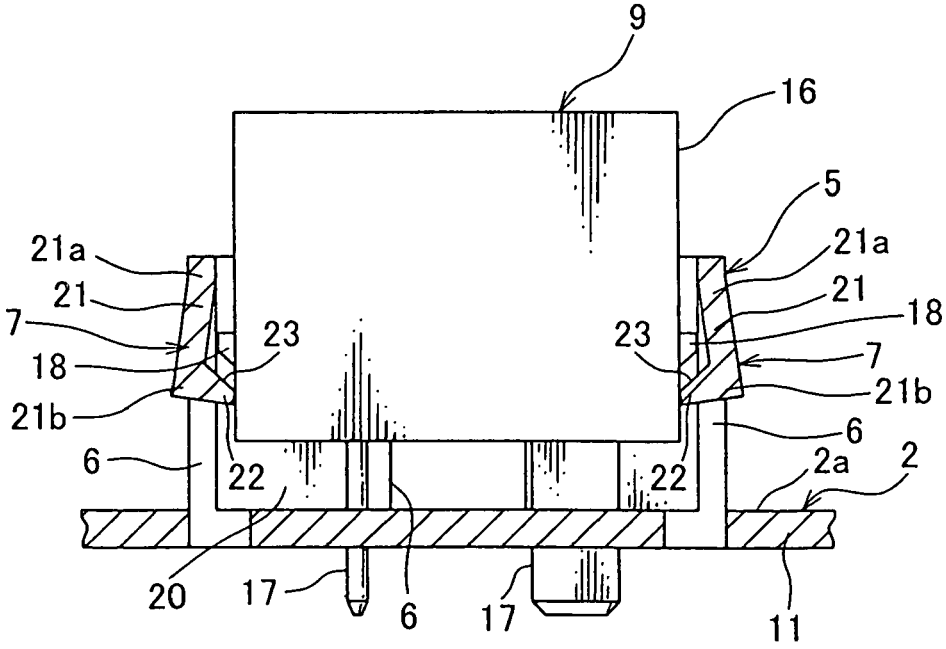
FIG. 5 is a cross-sectional view showing condition in which the electric component of FIG. 4 is further inserted into the tube.

The terminal 17 of the relay 9 is passed through the through hole 8 of the attachment portion 4. And then, the main body 16 of the relay 9 is inserted into the tube 5 of the attachment portion 4. As a result, the main body 16 of the relay 9 abuts to the slope 23 of the protrusion 22 of the holding portion 7 in the attachment portion 4. Thereby, as shown in FIG. 5, the arm 21 of the holding portion in the attachment portion 4 is resiliently deformed. Furthermore, the protrusion 22 of the holding portion 7 is pushed into the tube 5 by the main body 16 of the relay 9.

Figure 6:
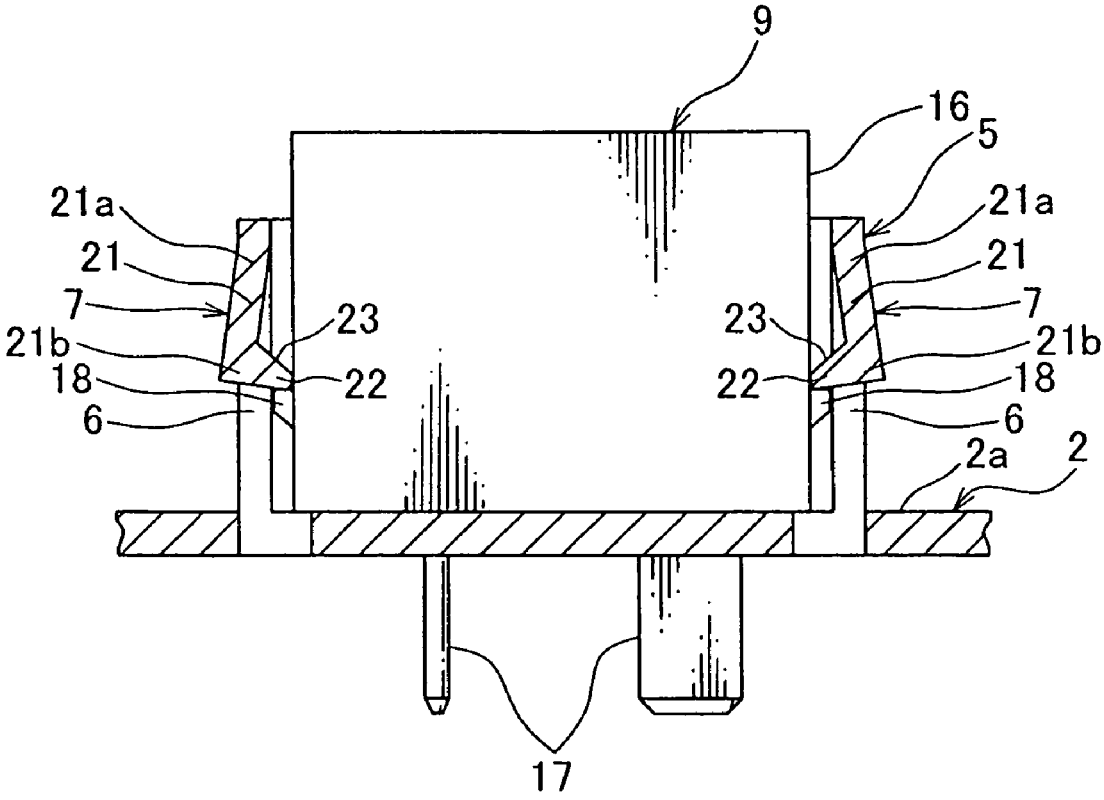
FIG. 6 is a cross-sectional view showing condition on which the electric component is assembled in the attachment portion of FIG. 5.

Then, when the main body 16 of the relay 9 is inserted into the tube 5, as shown in FIG. 6, the protrusion 22 of the holding portion 7 is locked with the locking protrusion 18 over the locking protrusion 18.

The holding portion 7 holds the main body 16 of the relay 9 to the tube 5 by elastic restoring force of the arm 21. Additionally, the protrusion 22 of the holding portion 7 is fitted with the locking protrusion 18 of the relay 9 respectively. Thereby, the main body of the relay 9 is fixed in the tube 5. Thus, the above electric connection box 1 attaches the relay 9 to the attachment portion 4 of the box body 2.

In the embodiment of the invention, the attachment portion 4 which is arranged on the upper surface 2*a* of the box body 2 includes the tube 5, the plurality of the openings 6 and the plurality of the holding portions 7. The attachment portion 4 inserts the relay 9 into the inside thereof. The tube 5 extends from the upper surface 2*a* of the box body 2. The opening 6 passes through the tube 5, and is arranged with a space along the circumferential direction of the tube 5. The holding portion 7 is arranged in the opening 6, and holds the relay 9 to the tube 5 by pressing the relay 9 toward the inside of the tube 5. Each of the holding portions 7 includes the arm 21 and the protrusion 22 projecting toward the inside of the tube 5 from another end of the arm 21. One end 21*a* of the arm 21 continues to the inner edge of the tube away from the surface of the box body. Another end 21*b* thereof is formed with a free end.

Therefore, when the relay 9 is inserted into the tube 5 of the attachment portion 4, the arm 21 of the holding portion 7 is elastic deformed. In addition, the protrusion 22 of the holding portion 7 is pressed to an outside of the tube 5 by the relay 9. Thereby, insertion force which inserts the relay 9 into the tube 5 of the attachment portion 4 can be reduced. Therefore, it is possible to attach the relay 9 to the attachment portion 4 of the box body 2 easily.

Furthermore, when the relay 9 is received in the tube 5, at least the two protrusions 22 opposed to each other lock with the locking protrusion 18 of the relay 9. Thereby, holding and fixing the relay 9 to the tube 5 can be performed together simply by inserting the relay 9 into the tube 5 of the attachment portion. For this reason, it is possible to reduce the number of parts and working process for attaching the relay 9 to the attachment portion 4 of the box body 2.

Also, the protrusion 22 includes the slope 23. Thereby, when the protrusion 22 of the holding portion 7 is pressed to the outside of the tube 5 by the relay 9 which is inserted to the tube 5 of the attachment portion 4, friction between the relay 9 and the protrusion 22 of the holding portion 7 can be reduced. Therefore, insertion force for inserting the relay 9 into the tube 5 of the attachment portion 4 can be reduced, and the relay 9 can be smoothly inserted into the tube 5 of the attachment portion 4. In addition, damage of the relay 9 and protrusion 22 of the holding portion 7 can decrease, and the relay 9 can be steadily fixed to the attachment portion 4 of the box body 2.

In the above embodiment, the relay 9 is explained as an example of the electric component which is attached to the attachment portion 4 of the box body 2 in the electric connection box 1. However, the present invention is not limited thereto. For example, a fuse may be used as the electric component.

The embodiment of the present invention is only exemplary and not limited thereto. Modifications are possible within the scope of the present invention.

What is claimed is:

1. An electric connection box comprising:

a box body; and an attachment portion for attaching an electric component on a surface of the box body, the attachment portion includes a plurality of through holes arranged on the surface of the box body for passing through terminals extending from the electric component, a tube standing from the surface of the box body for receiving the electric component into an inside of the tube, a plurality of openings passing through the tube and arranged with a space along a circumferential direction of the tube, and a plurality of holding portions provided in the openings and holding the electric component to the tube by pressing the electric component into the inside of the tube, wherein each of the holding portions includes an arm and a protrusion projecting toward the inside of the tube from another end of the arm, one end of the arm continues to an inner edge of the tube away from the surface of the box body, and the other end thereof is formed with a free end; and the holding portions flex outwardly when the electronic component is received into the inside of the tube and is in a final connected state, such that a restoring force of the arm holds the electric component to the tube.

2. The electric connection box as claimed in claim 1, wherein at least two of the protrusions opposed to each other respectively lock with locking protrusions of the electric component when the electric component is received in the tube.

3. The electric connection box as claimed in claim 1, wherein the protrusion includes a slope narrowing toward a top of the protrusion at the other end side whereas one end side of the protrusion faces the surface of the box body.

4. The electric connection box as claimed in claim 2, wherein the protrusion includes a slope narrowing toward a top of the protrusion at the other end side whereas one end side of the protrusion faces the surface of the box body.

* * * * *